US010544586B1

(12) United States Patent
Smed

(10) Patent No.: US 10,544,586 B1
(45) Date of Patent: Jan. 28, 2020

(54) CEILING SYSTEM

(71) Applicant: Ole Falk Smed, Calgary (CA)

(72) Inventor: Ole Falk Smed, Calgary (CA)

( * ) Notice: Subject to any disclaimer, the term of this patent is extended or adjusted under 35 U.S.C. 154(b) by 0 days.

(21) Appl. No.: 16/420,620

(22) Filed: May 23, 2019

Related U.S. Application Data

(63) Continuation-in-part of application No. 15/971,681, filed on May 4, 2018, now abandoned.

(51) Int. Cl.

| | |
|---|---|
| ***E04B 9/28*** | (2006.01) |
| ***E04B 9/06*** | (2006.01) |
| ***E04B 9/24*** | (2006.01) |
| ***E04B 9/04*** | (2006.01) |

(52) U.S. Cl.
CPC ..... *E04B 9/28* (2013.01); *E04B 9/0435* (2013.01); *E04B 9/067* (2013.01); *E04B 9/24* (2013.01); *E04B 2103/04* (2013.01)

(58) Field of Classification Search
CPC ..... E04B 9/242; E04B 9/28; E04B 9/04
USPC ..... 52/506.03, 506.04, 506.07, 506.09, 52/506.05, 506.06
See application file for complete search history.

(56) References Cited

U.S. PATENT DOCUMENTS 1,896,769 A * 2/1933 Davis ..... E04B 9/16 52/359
2,822,584 A * 2/1958 Urbain ..... E04B 9/16 52/506.09
3,055,469 A * 9/1962 Byssing ..... E04B 9/16 52/506.09
3,381,437 A * 5/1968 Kidney ..... E04B 9/28 52/779
3,640,042 A * 2/1972 Kidney ..... E04B 9/247 52/506.09
3,736,012 A * 5/1973 Boylan ..... E04B 9/16 52/506.07
4,467,578 A * 8/1984 Weinar ..... E04B 2/7457 52/281
4,908,915 A * 3/1990 Ruggles ..... E04B 2/821 24/336
5,428,930 A * 7/1995 Bagley ..... E04B 9/003 52/483.1
5,822,941 A * 10/1998 Kinsella ..... E04B 9/006 52/506.05
6,880,306 B2 * 4/2005 Burken ..... E04F 13/0823 52/483.1
7,640,701 B2 * 1/2010 Rutherford ..... E04B 2/825 52/242

(Continued)

*Primary Examiner* — Joshua K Ihezie
(74) *Attorney, Agent, or Firm* — Carl A. Hjort, III

(57) ABSTRACT

A ceiling system with a plurality of T-bars attached to structural members defining a roof of a building; a plurality of clips having two ears depending upwardly from an upper horizontal member, a back wall depending downwardly from the upper horizontal surface and a panel engaging member connected to the back wall; a plurality of panels having a generally rectangular shape, an outward facing surface with microperforations thereon, and a slit on the major edge, wherein the panel engagement member of the clip is completely received within the slit and the back wall of the clip abuts an edge of the panel; and wherein the ears of the clip engage with the edges of a T-bar and secure the clip to the T-bar, and wherein each panel is attached by the clips to at least two T-bars.

5 Claims, 10 Drawing Sheets

(56) References Cited

U.S. PATENT DOCUMENTS

| | | | | |
|---|---|---|---|---|
| 8,549,810 | B1 * | 10/2013 | Norton | E04B 9/245<br>52/506.06 |
| 2003/0182894 | A1 * | 10/2003 | Galsgaard | E04B 9/067<br>52/747.1 |
| 2006/0005495 | A1 * | 1/2006 | Stessel | E04B 9/003<br>52/506.07 |
| 2007/0056234 | A1 * | 3/2007 | Wenstrup | D04H 13/00<br>52/220.6 |
| 2008/0155927 | A1 * | 7/2008 | Wendt | E04B 9/003<br>52/506.07 |
| 2009/0165410 | A1 * | 7/2009 | Wuts | E04B 1/7675<br>52/302.1 |
| 2009/0173030 | A1 * | 7/2009 | Gulbrandsen | E04B 9/0414<br>52/506.09 |
| 2010/0139189 | A1 * | 6/2010 | LaLonde | E04B 9/06<br>52/220.6 |
| 2012/0102865 | A1 * | 5/2012 | Baxter | E04B 7/14<br>52/506.06 |
| 2012/0304575 | A1 * | 12/2012 | Vakhnin | E04B 9/068<br>52/506.07 |

* cited by examiner

CEILING SYSTEM

CROSS-REFERENCE TO RELATED APPLICATIONS

This application is a continuation-in-part of U.S. patent application Ser. No. 15/971,681, filed on May 4, 2018, now abandoned.

DETAILED DESCRIPTION OF THE DRAWINGS

Embodiments of a ceiling system are shown. The ceiling system having a plurality of T-bars, each having an upright portion and a perpendicular portion, the T-bars being attached to structural members defining a roof of a building. The ceiling system further comprising a plurality of clips, each of the clips having two ears depending upwardly from an upper horizontal member, a back wall depending downwardly from the upper horizontal surface and a panel engaging member connected to the back wall. Further, the ceiling system has a plurality of panels having a generally rectangular shape, the panels having major edges and minor edges and an outward facing surface, said panels having a slit on the major edge, wherein the panel engagement member of the clip is completely received within the slit and the back wall of the clip abuts an edge of the panel; and wherein the ears of the clip engage with the edges of the perpendicular portion of the T-bar and secure the clip to the T-bar, and wherein each panel is attached by the clips to at least two T-bars.

Figure 1A:
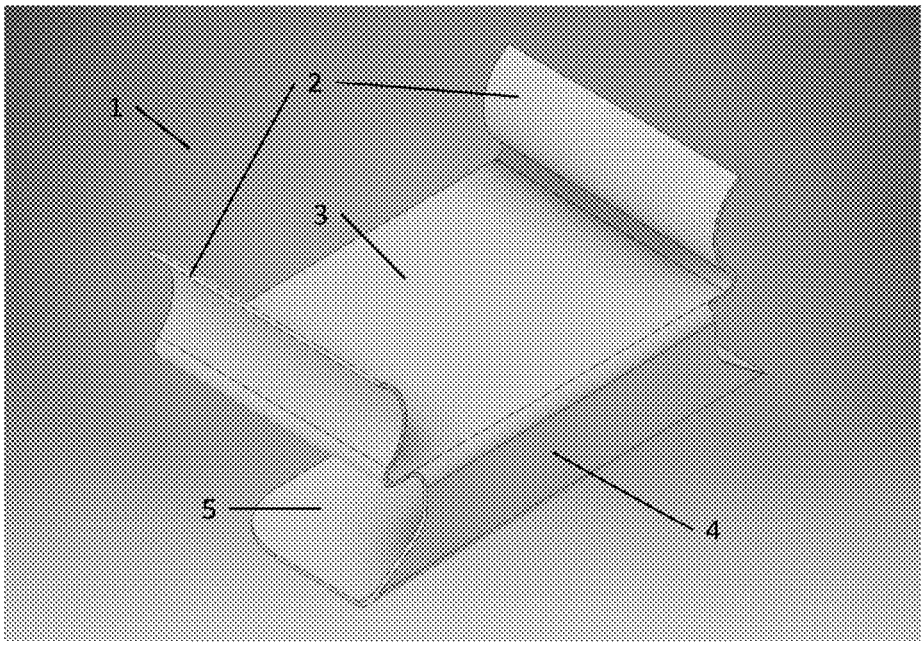
FIG. 1*a* is a perspective view of an embodiment of a clip for a ceiling system.
Figure 1B:
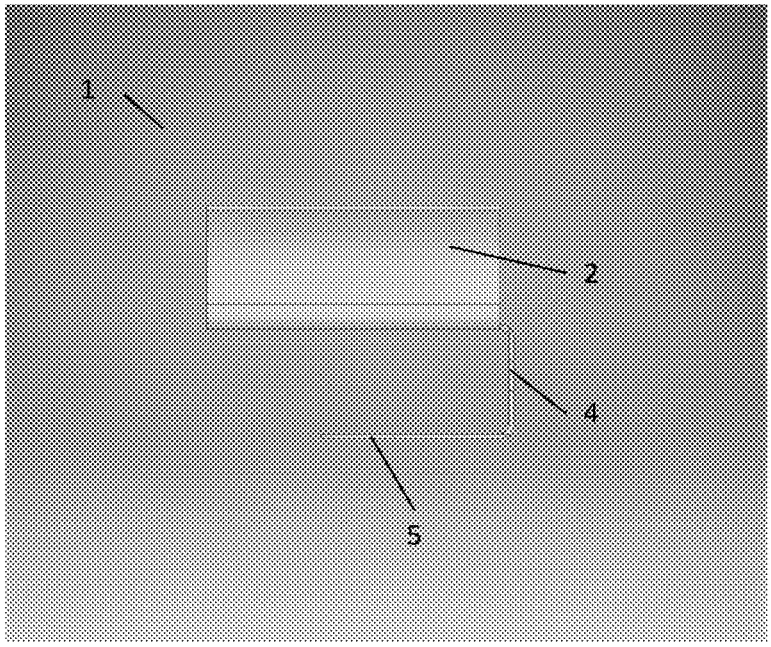
FIG. 1*b* is a side view of an embodiment of a clip for a ceiling system.

FIGS. 1*a* and 1*b* show perspective and side views of an embodiment of a clip for use in a ceiling system. Like numerals will be used to denote the same elements in FIGS. 1*a* and 1*b*. Thus, as can be seen in FIG. 1*a*, the clip 1 is provided with two ears 2. The ears 2 depend upwardly from upper horizontal member 3. As will be discussed later, the ears 2 engage with the edges of a T-bar and secure the clip to the T-bar. The T-bar rides against the upper horizontal member 3 when the clip is assembled on the T-bar. Also visible in FIG. 1*a* is the back wall 4. As can be best seen in FIG. 1*b*, back wall 4 depends downwardly from upper horizontal surface 3 and connects the upper horizontal surface to the panel engaging member 5. As will be discussed later, the panel engagement member 5 is received in a slit in a panel for the ceiling system. When assembled, the panel engagement member 5 is completely received within the slit in the panel and the back wall 4 abuts the edge of the panel.

Figure 2A:
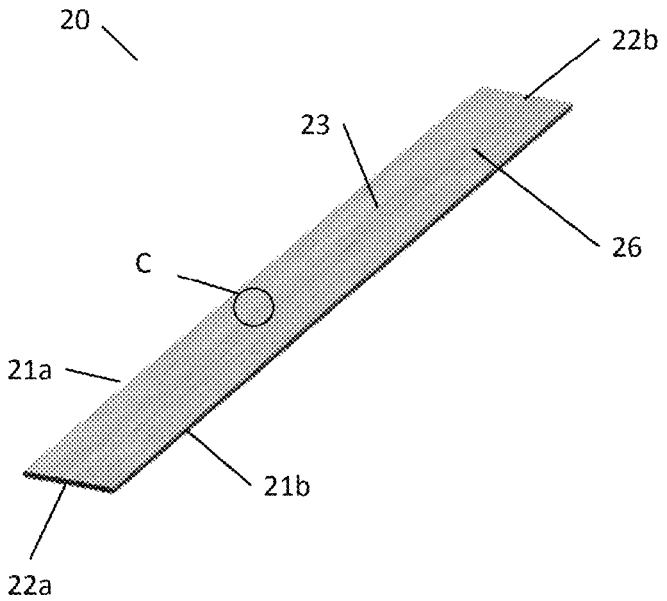
FIG. 2*a* is a top perspective view of an embodiment of a panel for a ceiling system.
Figure 2B:
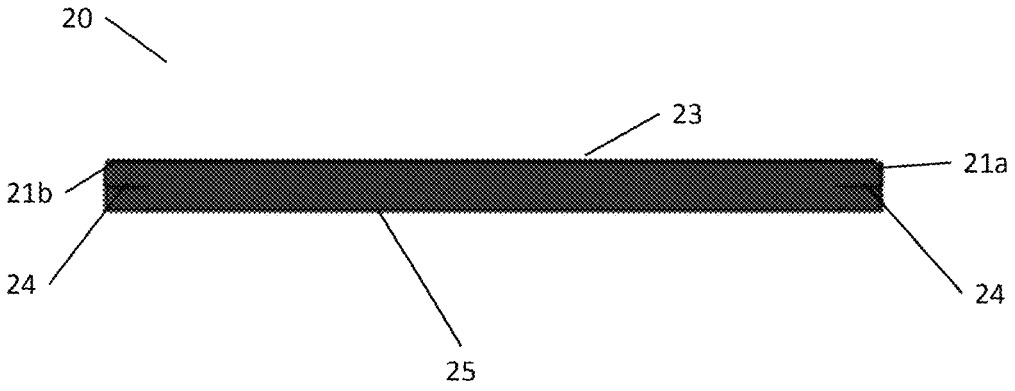
FIG. 2*b* is a cross-section view of an embodiment of a panel for a ceiling system.

FIGS. 2*a* and 2*b* show various views of an embodiment of a panel for a ceiling system. As can be seen in FIG. 2*a* the panel 20 takes a generally rectangular shape, though one of ordinary skill in the art will appreciate that the shape of the panel can be varied depending on the configuration required for a given application of the ceiling system. As noted in FIG. 2*a*, the panel has a major edges 21*a* and 21*b* and minor edges 22*a* and 22*b* and an outward facing surface 23. The panel 20 may be constructed of polyester fiberboard, and more particularly a 12 mm Class "A" polyester fiberboard. The outward facing surface 23 of this polyester fiberboard may then be covered with a wood grain embossed PVC film 26. Referring now to the cross-sectional view of FIG. 2*b*, slits 24 are provided in the major edges, 21*a* and 21*b* of the panel. The slit 24 is provided to accommodate the panel engagement member 5 of the clip 1 as discussed above. Wood grain PVC film 26 is disposed on the outward facing, suffice 23. No PVC film is provided on or below the slit 24 on edges 21*a* and 21*b*. No PVC film is disposed on the back side 25 of the panel, as this portion of the panel will not be visible when the panel is installed.

Figure 2C:
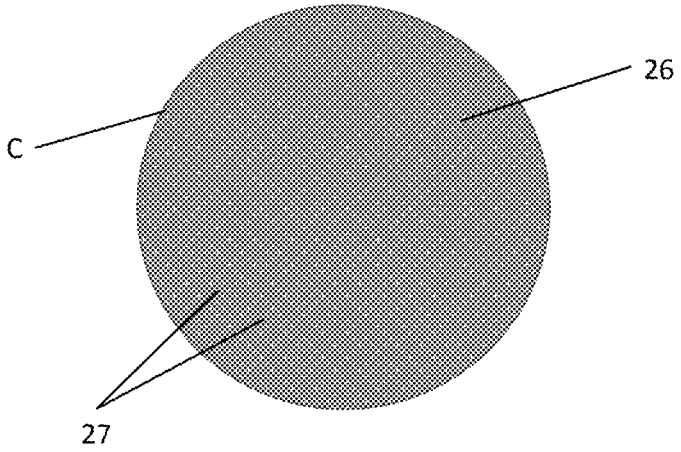
FIG. 2*c* is an enlarged view of the encircled portion "C" in FIG. 2*a*.

FIG. 2*c* is an enlarged view of the encircled area labelled "C" in FIG. 2*a*. As can be seen in FIG. 2*c*, the outward facing surface 23 of the panel 20, which is covered in the wood grain embossed PVC film 26, has a plurality of microperforations 27 formed in the PVC film 26. It should be appreciated that the view of FIG. 2*c* is highly magnified, and the microperforations 27 are quite small, though they are visible to the naked eye, if the panel 20 is inspected very closely. The microperforations 27 have a circular shape and a diameter in the range of 0.05 to 1 mm and more preferably in the range of 0.25 to 0.75 mm. It should be further appreciated that while FIG. 2*c* shows only the section denoted "C" in FIG. 2*a*, the microperforations 27 formed in the PVC film 26 cover the entire outward facing surface 23 of the panel 20. The microperforations 27 extend all the way through the PVC film 26.

Figure 3:
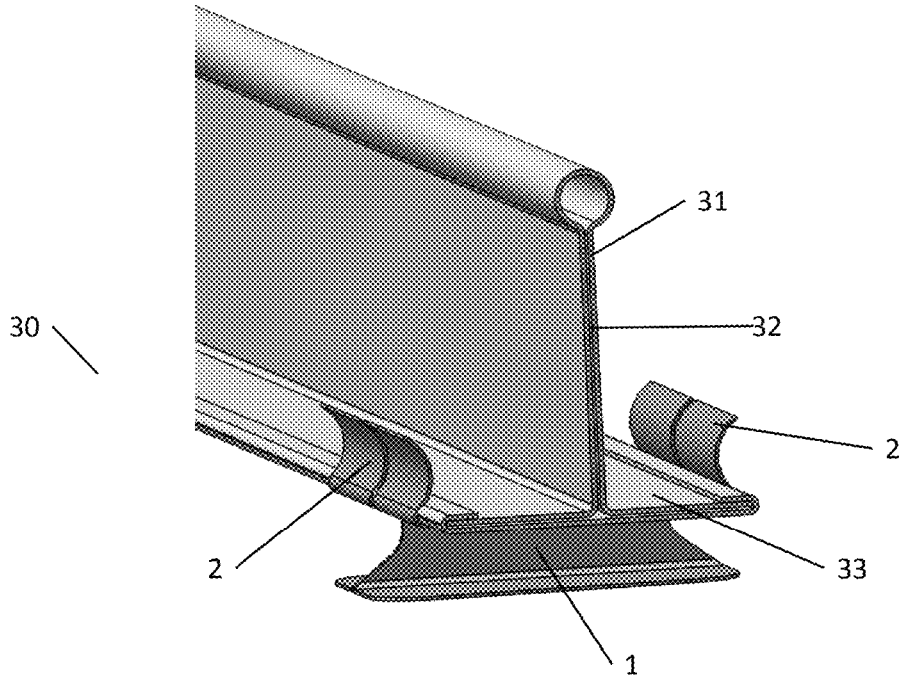
FIG. 3 shows an embodiment of a clip for a ceiling system engaged with a T-bar.

FIG. 3 shows an embodiment of a clip for a ceiling system engaged with a T-bar. The assembly 30 shown in FIG. 3 has a T-bar 31, which has upright portion 32 and perpendicular portion 33. The T-bar is attached to rafters or other structural members defining a roof of a building as would be understood by one of ordinary skill in the art. Referring again to the numerals used in connection with the description of the clip 1 in FIGS. 1*a* and 1*b*, the ears 2 of clip 1 engage with the perpendicular portion 33 of the T-bar 31. The underside surface (not shown) of perpendicular portion 33 is in contact with the upper horizontal member 3 of the clip 1.

Figure 4A:
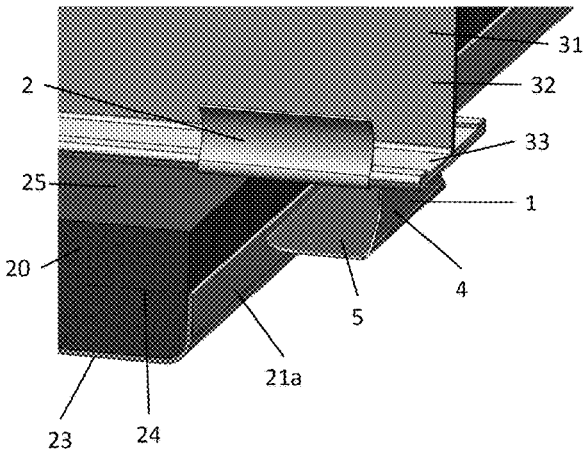
FIG. 4*a* shows a partially exploded view of the clip for a ceiling system engaged with a T-bar and separated from the panel for the ceiling system.
Figure 4B:
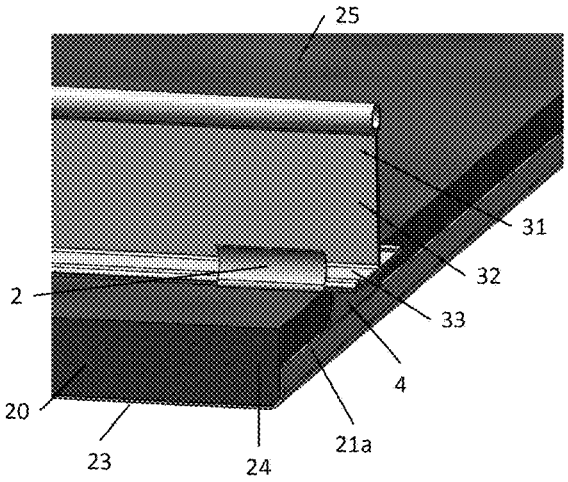
FIG. 4*b* shows an assembled view of the T-bar, clip and panel for the ceiling system.

FIGS. 4*a* and 4*b* show partially exploded and assembled views of the T-bar, clip and panel for the ceiling system. Using numerals used to describe like elements with respect to previous figures, and referring now to FIG. 4*a*, the T-bar 31 with upright portion 32 and the perpendicular portion 33 are shown. Clip 1 is engaged with T-bar 31 by way of ears 2 and the underside (not shown) of perpendicular portion 33 is in contact with the upper horizontal member (not visible) of the clip 1. Also visible in FIG. 4*a* are the back wall 4 and panel engagement member 5 of the clip 1. Panel 20 is also visible in FIGS. 4*a* and 4*b*, including the major edge 21*a*, the slit 24, the outward facing surface 23 and the back side 25. When assembled, as shown in FIG. 4*b*, the panel engagement member 5 of clip 1 is pushed into slit 24 in panel 20, thereby securing the clip 1 and attached T-bar 31 to panel 20. It should be appreciated that the underside (not shown) of perpendicular portion 33 contacts the back side 25 of the panel 20, when the clip 1 and T-bar 31 are assembled to the panel 20.

Figure 5A:
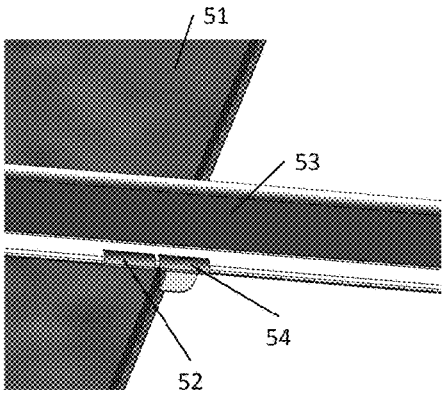
FIG. 5*a* is a partial assembled view of a ceiling system.
Figure 5B:
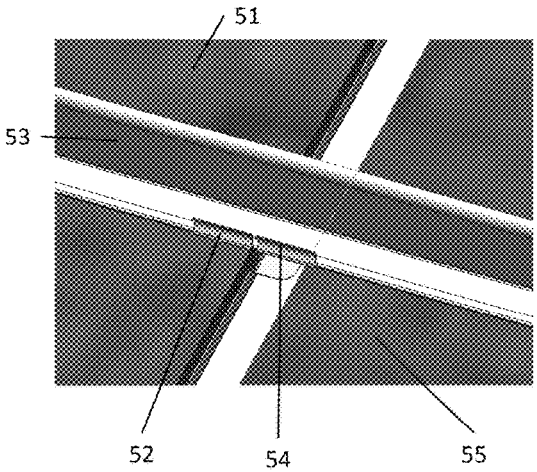
FIG. 5*b* is a partial exploded view of the assembly of a ceiling system.
Figure 5C:
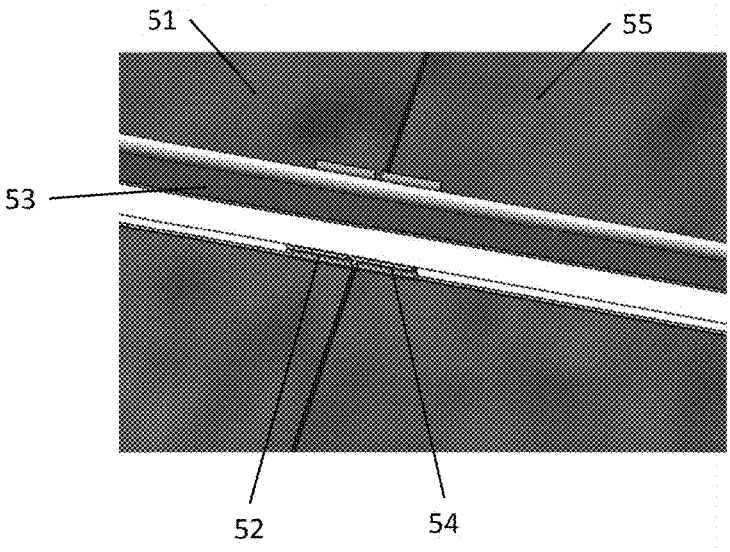
FIG. 5*c* is an assembled view of a section of a ceiling system.
Figure 6:
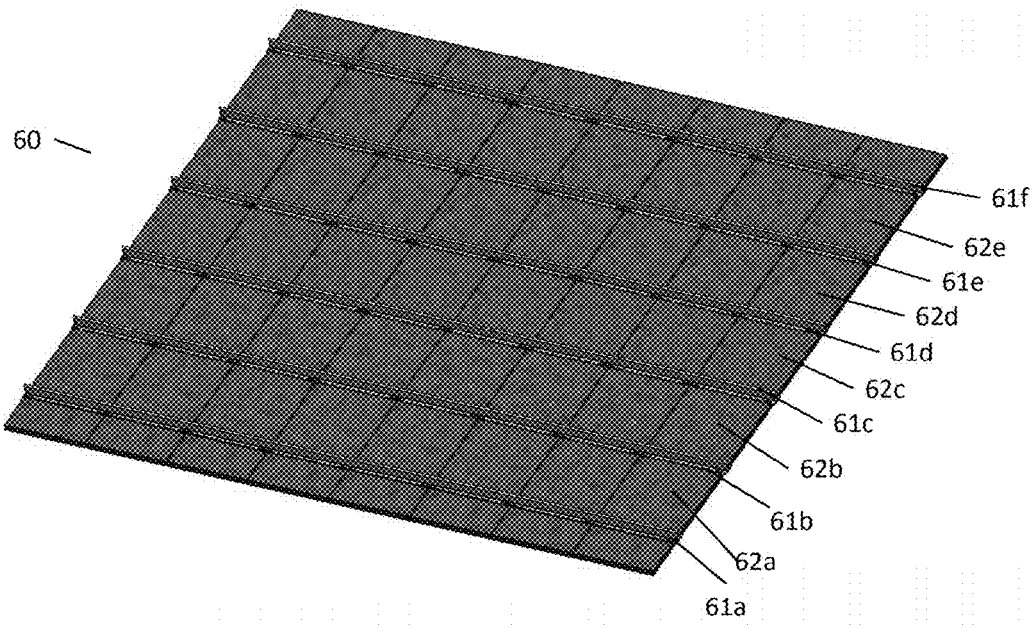
FIG. 6 is a top perspective view of an assembled ceiling system.

FIGS. 5*a-c* and 6 show assembled and exploded views of the present ceiling system. In FIG. 5*a* a first panel 51 is attached via clip 52 to T-bar 53 as has been previously described. A second clip 54 is also provided. In FIG. 5*b*, a second panel 55 is also provided. In the assembled view of FIG. 5*c*, the second panel 55 is placed into engagement with the second clip 54. It should be appreciated that at least four clips are required, one at each corner of the panel to attach the panel to the T-bar. More preferably, the clips may be disposed at 2 foot intervals along the major edge of the panel to connect the panel to the T-bar. FIG. 6 shows a top perspective view of an assembled ceiling system. In FIG. 6, T-bars 61*a-f* are provided that all have clips (not visible) that allow panels 62*a-e* to be connected to them. In this way adjacent panels may be connected to at least two T-bars via the clips as herein described and the entire ceiling assembly is tied together. It should be appreciated that the underside of this assembly 60 shown in FIG. 6 is the outward facing surface of the panels that has wood veneer or a wood grain embossed PVC film disposed thereon.

It will be appreciated by those of ordinary skill in the art that, while the forgoing disclosure has been set forth in connection with particular embodiments and examples, the disclosure is not intended to be necessarily so limited, and that numerous other embodiments, examples, uses, modifications and departures from the embodiments, examples and uses described herein are intended to be encompassed by the claims attached hereto. Various features of the disclosure are set forth in the following claims.

The invention claimed is:

1. A ceiling system comprising:

a plurality of T-bars, each having an upright portion and a perpendicular portion, the T-bars being attached to structural members defining a roof of a building;

a plurality of clips, each of the clips having two ears depending upwardly from an upper horizontal member, a back wall depending downwardly from the upper horizontal member and a panel engaging member connected to the back wall;

a plurality of panels having a generally rectangular shape, the panels having major edges and minor edges and an outward facing surface, said panels having a slit on the major edge, wherein the panel engagement member of the clip is completely received within the slit and the back wall of the clip abuts an edge of the panel;

wherein the ears of the clip engage with the edges of the perpendicular portion of the T-bar and secure the clip to the T-bar, and wherein each panel is attached by the clips to at least two T-bars;

wherein the plurality of panels are constructed of polyester fiberboard and the outward facing surface of the plurality of panels is covered with a wood grain embossed PVC film; and wherein said wood grain embossed PVC film has a plurality of microperforations therein, said plurality of microperforations covering the entire outward facing surface of the panel.

2. The ceiling system of claim 1, wherein the plurality of panels are constructed of a 12 mm Class "A" polyester fiberboard.

3. The ceiling system of claim 1, wherein no covering is placed on the plurality of panels on the side opposed to the outward facing surface.

4. The ceiling system of claim 1, wherein the panels are secured to the T-bars by clips spaced two feet apart.

5. The ceiling system of claim 1, wherein the panel is secured to the T-bars by four clips, one clip located at each corner of the panel.

* * * * *